US011505981B2

(12) United States Patent
Kim et al.

(10) Patent No.: US 11,505,981 B2
(45) Date of Patent: Nov. 22, 2022

(54) SLIDING DOOR FOR VEHICLE

(71) Applicants: Hyundai Motor Company, Seoul (KR); Kia Motors Corporation, Seoul (KR)

(72) Inventors: Sang Cheon Kim, Hwaseong-si (KR); Hong Lim Choi, Seongnam-si (KR); Sang Woo Kim, Seongnam-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 136 days.

(21) Appl. No.: 17/015,731

(22) Filed: Sep. 9, 2020

(65) Prior Publication Data

US 2021/0363809 A1 Nov. 25, 2021

(30) Foreign Application Priority Data

May 25, 2020 (KR) ..... 10-2020-0062597

(51) Int. Cl.
*E05D 15/10* (2006.01)
*E05F 15/638* (2015.01)
*E05F 15/662* (2015.01)

(52) U.S. Cl.
CPC ..... *E05F 15/638* (2015.01); *E05F 15/662* (2015.01); *E05Y 2201/624* (2013.01);
(Continued)

(58) Field of Classification Search
CPC ..... E05F 15/638; E05F 15/662; E05Y 2201/624; E05Y 2201/636;
(Continued)

(56) References Cited

U.S. PATENT DOCUMENTS 2,589,493 A * 3/1952 Henry, Jr. ..... E05D 15/56 49/221
4,606,146 A * 8/1986 Jozefozak ..... E05D 15/1081 49/225
6,030,024 A * 2/2000 Schmidhuber ..... B60J 5/0497 296/146.12
7,178,853 B2 * 2/2007 Oxley ..... B60J 5/06 49/223
8,096,606 B2 * 1/2012 Hanaki ..... E05F 15/646 49/358
(Continued)

FOREIGN PATENT DOCUMENTS

DE 102020109081 A1 * 4/2021 ..... E05B 79/20
DE 102020125091 A1 * 11/2021 ..... E05F 15/638
(Continued)

*Primary Examiner* — Jerry E Redman
(74) *Attorney, Agent, or Firm* — Morgan, Lewis & Bockius LLP

(57) ABSTRACT

A sliding door for a vehicle, which is applicable to a door portion to which a straight rail is difficult to be applied, may include a door rail mounted in a door which is configured to be closed to a vehicle body in a vertical direction of the vehicle; a vehicle body rail mounted in the vehicle body to which the door is configured to be closed in a longitudinal direction of the vehicle; and a moving arm having one end portion which is movably coupled along the door rail in the vertical direction to open or close the door in a transverse direction of the vehicle body during moving, and the other end portion which is movably coupled along the vehicle body rail in a longitudinal direction to allow the door to be slidingly moved in a longitudinal direction of the vehicle body during moving.

14 Claims, 7 Drawing Sheets

(52) U.S. Cl.
CPC ..... *E05Y 2201/636* (2013.01); *E05Y 2201/652* (2013.01); *E05Y 2201/668* (2013.01); *E05Y 2201/674* (2013.01); *E05Y 2201/684* (2013.01); *E05Y 2201/688* (2013.01); *E05Y 2201/706* (2013.01); *E05Y 2201/716* (2013.01); *E05Y 2201/722* (2013.01); *E05Y 2600/46* (2013.01); *E05Y 2900/531* (2013.01)

(58) Field of Classification Search
CPC ..... E05Y 2201/652; E05Y 2201/668; E05Y 2201/674; E05Y 2201/684; E05Y 2201/688; E05Y 2201/706; E05Y 2201/716; E05Y 2201/722; E05Y 2600/46; E05Y 2900/531; E05D 15/101; E05D 15/1007
USPC ..... 49/209, 210, 211, 213, 216, 221, 223
See application file for complete search history.

(56) References Cited

U.S. PATENT DOCUMENTS

| | | | | |
|---|---|---|---|---|
| 9,777,811 | B2 * | 10/2017 | Choi | B60J 5/06 |
| 10,384,519 | B1 * | 8/2019 | Brown | B60J 5/047 |
| 10,914,108 | B2 * | 2/2021 | Yun | B60J 5/06 |
| 11,085,224 | B2 * | 8/2021 | Loeb | E05F 15/649 |
| 2009/0072583 | A1 * | 3/2009 | Elliott | B60J 5/0479 296/24.3 |
| 2021/0108455 | A1 * | 4/2021 | Yun | E05F 1/16 |
| 2021/0355736 | A1 * | 11/2021 | Kim | E05F 15/646 |
| 2021/0363809 | A1 * | 11/2021 | Kim | E05F 15/662 |

FOREIGN PATENT DOCUMENTS

| | | | | | |
|---|---|---|---|---|---|
| EP | 357543 | A | * | 3/1990 | B60J 5/06 |
| GB | 2441334 | A | * | 3/2008 | B60J 5/047 |
| KR | 10-2020-0027379 | A | | 3/2020 | |
| WO | WO-9725505 | A1 | * | 7/1997 | B60J 5/047 |
| WO | WO-2020025345 | A1 | * | 2/2020 | E05D 15/101 |

* cited by examiner

SLIDING DOOR FOR VEHICLE

CROSS REFERENCE TO RELATED APPLICATION

The present application claims priority to Korean Patent Application No. 10-2020-0062597 filed on May 25, 2020, the entire contents of which is incorporated herein for all purposes by this reference.

BACKGROUND OF THE INVENTION

Field of the Invention

The present invention relates to a sliding door for a vehicle, which is applicable to a door portion to which a straight rail is difficult to be applied.

Description of Related Art

In passenger vehicles for leisure and vans, sliding doors which are opened or closed by pushing the sliding doors in a longitudinal direction are employed.

A straight rail is fixed to a vehicle body and a door in the front and rear direction thereof, and the sliding door is fixed to the vehicle body through a roller and hinge structure so that the door may be guided along a trajectory of the rail to be opened or closed in a sliding manner.

However, the conventional sliding door has a problem in that the rail of the door is exposed to an interior of a vehicle to degrade an aesthetically pleasing feeling in terms of an interior design. Furthermore, there is a difficulty in configuring a layout of an interior of the door in addition to a door glass.

Since the rail is a straight shape, the rail is applicable to a rear door, but there is a disadvantage in that it is difficult for the rail to be applied to a front door of which a roof side portion is formed to be inclined downward.

The information included in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing a sliding door for a vehicle, which is applicable to a door portion to which a straight rail is difficult to be applied in terms of a design.

According to one aspect, there is provided a sliding door for a vehicle, which includes a door rail mounted in a door which is configured to be closed to a vehicle body in a vertical direction of the vehicle; a vehicle body rail mounted in the vehicle body to which the door is configured to be closed in a longitudinal direction of the vehicle; and a moving arm having one end portion which is movably coupled along the door rail in the vertical direction to open or close the door in a transverse direction of the vehicle body during moving, and the other end portion which is movably coupled along the vehicle body rail in a longitudinal direction to allow the door to be slidingly moved in a longitudinal direction of the vehicle body during moving.

A rack gear may be provided along the door rail, and a gear module may be connected to the rack gear in a gear engagement structure at one end portion of the moving arm to be moved in the vertical direction, and simultaneously, to rotate the one end portion of the moving arm.

The gear module may include a module housing coupled to the door rail and guided by the door rail to slide in the vertical direction thereof, a drive external gear axially coupled to the module housing and engaged with the rack gear, a driven external gear axially coupled to the module housing and fixed to the one end portion of the moving arm, and an idle external gear axially coupled to the module housing and engaged between the drive external gear and the driven external gear, and configured to transmit a rotating force of the drive external gear to the driven external gear.

The sliding door may further include a motor configured to provide a driving force to the drive external gear.

When the gear module is moved from one end portion to the other of an entire vertical movement section, a gear ratio between the rack gear and the driven external gear may be configured such that the moving arm is rotated from one end portion to the other of an entire rotation section.

The door rail may be mounted on an internal surface of a door frame, and the vehicle body rail may be mounted on an external surface of a pillar.

The vehicle body rail may be mounted in a curved shape along an A-pillar or a C-pillar of the vehicle body, and the door rail may be vertically mounted in a portion of the door frame corresponding to a B pillar of the vehicle body.

A guide slit may be formed on a surface of the vehicle body rail facing the door in a longitudinal direction thereof, one end portion of a roller portion may be coupled to the other end portion of the moving arm in a ball joint structure, an intermediate portion of the roller portion may pass through the guide slit, and a roller provided at the other end portion of the roller portion may be inserted into the vehicle body rail and guided to be moved along the vehicle body rail.

The vehicle body rail may be formed in a torsional shape in the longitudinal direction thereof, the guide slit of the vehicle body rail adjacent to the B pillar may be formed to surface a lower end portion of the door rail, and the guide slit of the vehicle body rail far away from the B pillar may be formed to surface an upper end portion of the door rail.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
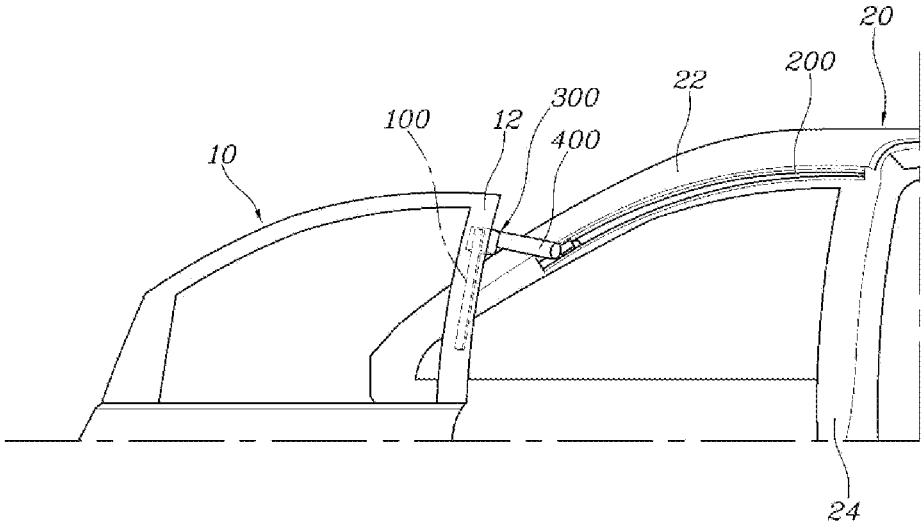
FIG. 1 is a diagram illustrating a state in which a door slides to be open according to various exemplary embodiments of the present invention from an exterior of a vehicle.

It may be understood that the appended drawings are not necessarily to scale, presenting a somewhat simplified representation of various features illustrative of the basic principles of the present invention. The specific design features of the present invention as included herein, including, for example, specific dimensions, orientations, locations, and shapes will be determined in part by the particularly intended application and use environment.

In the figures, reference numbers refer to the same or equivalent portions of the present invention throughout the several figures of the drawing.

DETAILED DESCRIPTION

Reference will now be made in detail to various embodiments of the present invention(s), examples of which are illustrated in the accompanying drawings and described below. While the present invention(s) will be described in conjunction with exemplary embodiments of the present invention, it will be understood that the present description is not intended to limit the present invention(s) to those exemplary embodiments. On the other hand, the present invention(s) is/are intended to cover not only the exemplary embodiments of the present invention, but also various alternatives, modifications, equivalents and other embodiments, which may be included within the spirit and scope of the present invention as defined by the appended claims.

Exemplary embodiments of the present invention will be described below with reference to the accompanying drawings.

A sliding door according to various exemplary embodiments of the present invention has a sliding door structure for being configured irrespective of a design line of a vehicle. The sliding door is applicable to an upper rail portion mounted at an upper end portion of a door 10. For reference, rail portions may be formed even at a lower end portion and an intermediate portion of the door 10. These rail portions may be applicable in a form of the existing straight rail structure.

Figure 2A:
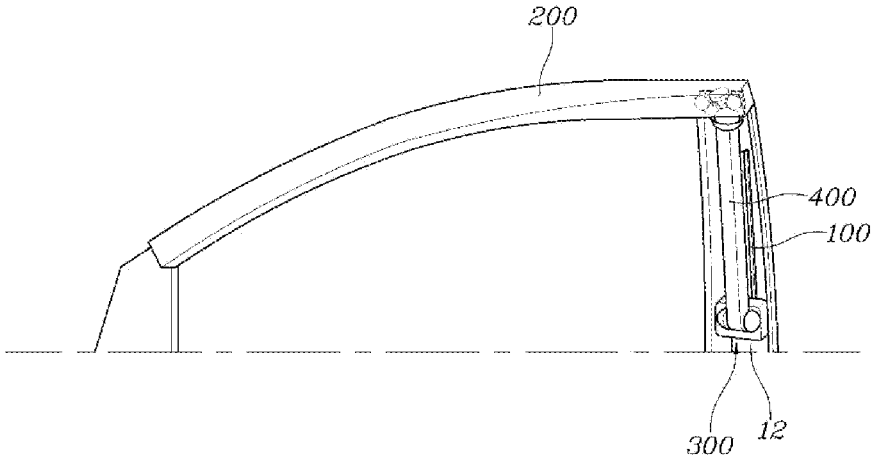
FIG. 2A, FIG. 2B, and FIG. 2C are diagrams for describing an opening and closing operation relationship of the door according to various exemplary embodiments of the present invention.
Figure 2B:
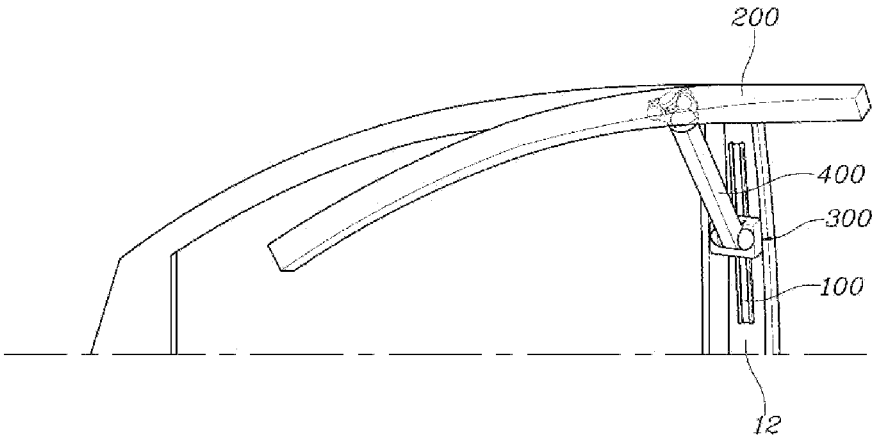
Figure 2C:
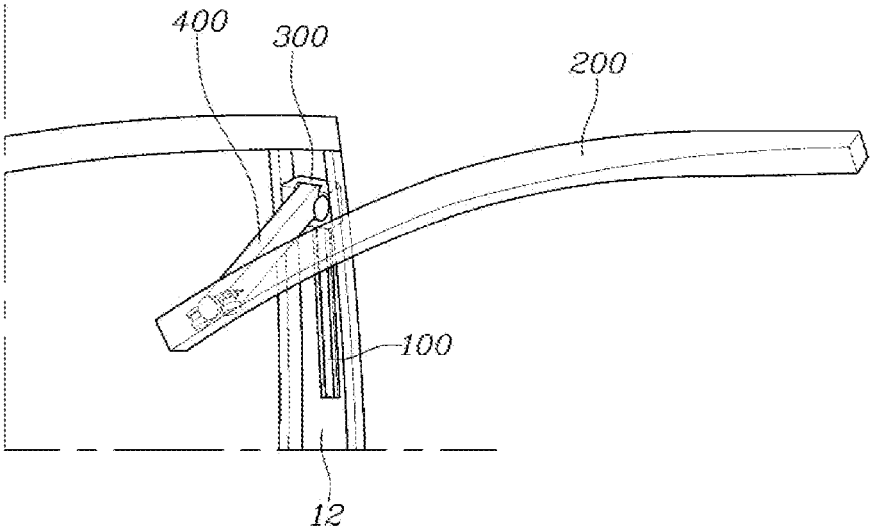

FIG. 1 is a diagram illustrating a state in which the door 10 slides to be opened according to various exemplary embodiments of the present invention from an exterior of a vehicle, and FIG. 2A, FIG. 2B, and FIG. 2C are diagrams for describing an opening and closing operation relationship of the door 10 according to various exemplary embodiments of the present invention. The door 10 includes a door rail 100, a vehicle body rail 200, and a moving arm 400.

Referring to the drawings, the present invention includes the door rail 100 mounted in the door 10 in a vertical direction of the vehicle, wherein the door 10 is closed to a vehicle body 20; the vehicle body rail 200 mounted in the vehicle body 20 to which the door 10 is closed in a longitudinal direction of the vehicle; and a moving arm 400 having one end portion connected to be movable along the door rail 100 in the vertical direction connected to open or close the door 10 in a longitudinal direction of the vehicle body 20 during moving and the other end portion connected to be movable along the vehicle body rail 200 in the front and rear direction to allow the door 10 to be slidably moved in a vertical direction of the vehicle body 20 during moving.

For example, the door rail 100 is vertically mounted on an internal surface of the door 10 facing an interior of the vehicle, and the vehicle body rail 200 is mounted on an external surface of the vehicle body 20 facing the exterior of the vehicle in the front and rear direction thereof. Furthermore, it is configured such that the one end portion of the moving arm 400 moves vertically along the door rail 100 and the other end portion thereof moves along the vehicle body rail 200 in the front and rear direction thereof.

That is, in the state in which the door 10 is closed, the one end portion of the moving arm 400 is located at a lowermost end portion of the door rail 100, and the other end portion thereof is located at a distal portion of one side of the vehicle body rail 200.

In the above state, when a force for opening the door 10 is provided, the one end portion of the moving arm 400 is moved upward along the door rail 100 to apply a force for pushing the door 10. In the present process, the door 10 is moved in the transverse direction of the vehicle body 20 so that a gap between the door 10 and the vehicle body 20 occurs.

Furthermore, when a pushing force is applied to the door 10 toward a distal portion of the other side of the vehicle body rail 200, the other end portion of the moving arm 400 moves along the vehicle body rail 200 so that the door 10 may slidingly move in a direction corresponding to the distal portion to open the door 10.

Alternatively, when the door 10 is closed in a state of being open, the door 10 and the moving arm 400 may move in a reverse order of the above description to close the door 10.

As described above, according to various exemplary embodiments of the present invention, when the door 10 is opened, the moving arm 400 moves along the door rail 100 mounted in the vertical direction to adjust a distance between the vehicle body 20 and the door 10. Thus, since there is no need to configure a rail in the front and rear direction of door 10, the sliding door may be applicable even to the door 10 in which it is difficult to implement a rail due to a layout problem of an interior of the door 10. It is possible to apply the sliding door even to a front portion of the door 10 in which a roof side portion is formed in a curved shape instead of a straight shape in terms of a design.

Furthermore, since a transverse movement amount of the door 10 is determined according to a length of the moving arm 400, when the door 10 is opened, the gap between the vehicle body 20 and the door 10 may be sufficiently secured as much as a desired level.

Figure 3:
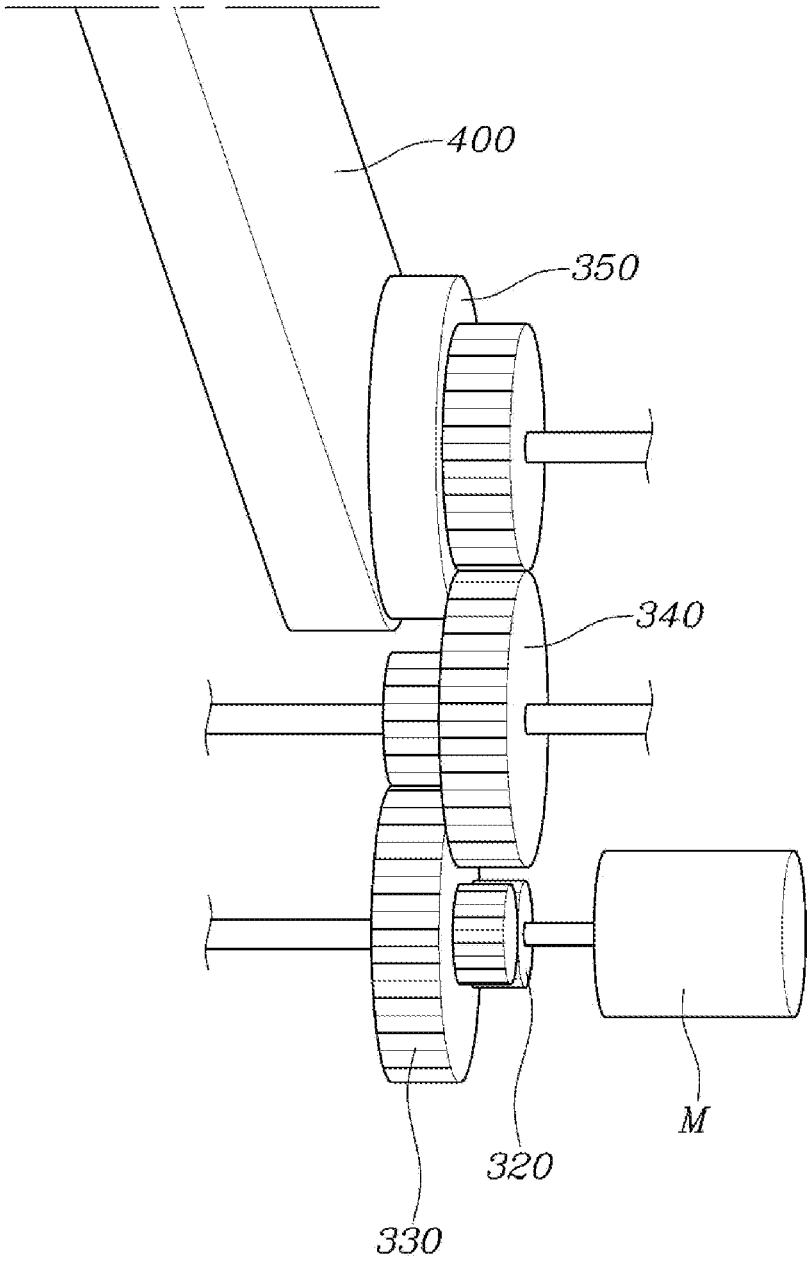
FIG. 3 is a diagram illustrating a gear engagement structure inside a gear module and an exemplary embodiment in which a driving force of a motor is provided to the gear module according to various exemplary embodiments of the present invention.

Furthermore, FIG. 3 is a diagram illustrating a gear engagement structure inside a gear module 300 and an exemplary embodiment in which a driving force of a motor M is provided to the gear module 300 according to various exemplary embodiments of the present invention. The door rail 100 and the moving arm 400 are connected through the gear engagement structure so that the moving arm 400 vertically moves along the door rail 100.

To describe with reference to the drawing, a rack gear 110 is provided at an intermediate portion of the door rail 100 along the door rail 100.

Furthermore, the gear module 300 is connected to the rack gear 110 at one end portion of the moving arm 400 in the gear engagement structure so that a structure is formed such that the gear module 300 is vertically moved, and simultaneously, one end portion of the moving arm 400 is rotated.

That is, when a force for opening the door 10 is provided to the gear module 300, gears in a gear module 300 are coupled to the rack gear 110 in the gear engagement structure so that the gear module 300 is vertically moved along the rack gear 110 and the moving arm 400 coupled to the gear module 300 is rotated.

To describe a configuration of the gear module 300 in detail, the gear module 300 includes a module housing 310 guided by the door rail 100 to slide vertically, a drive external gear 320 axially coupled to the module housing 310 and engaged with the rack gear 110, a driven external gear 350 axially coupled to the module housing 310 and fixed to one end portion of the moving arm 400, and an idle external gear axially coupled to the module housing 310 and engaged between the drive external gear 320 and the driven external gear 350 to transmit a rotating force of the drive external gear 320 to the driven external gear 350.

For example, the module housing 310 is formed in a shape of covering a portion of a front surface of the door rail 100. Rail grooves 313 are formed on both side surfaces of the door rail 100, and rail protrusions 316 inserted into the rail grooves 313 are formed at both sides of the module housing 310 so that the module housing 310 may be coupled to the door rail 100 to slidingly move in the vertical direction thereof.

Furthermore, in the module housing 310, the drive external gears 320, a plurality of idle external gears, and the driven external gears 350 are axially coupled to both the sides of the module housing 310 and rotated, and these externally engaged gears are connected to each other in an external engagement structure.

That is, the drive external gear 320 is coupled to a lower end portion of the module housing 310 to be coupled to the rack gear 110 in an engagement structure, a first idle external gear 330 is externally engaged with a front side of the drive external gear 320, a second idle external gear 340 is externally engaged to the first idle external gear 330 upward, and the driven external gear 350 is externally engaged to the second idle external gear 340 upward.

Furthermore, one end portion of the moving arm 400 is fixed to the driven external gear 350 so that the moving arm 400 is rotated according to a rotation of the driven external gear 350.

In the instant case, the externally engaged gears may be gears having a shape in which two gears having different external diameters coaxially overlap. This may be a shape in consideration of a gear ratio between the externally engaged gears. Thus, when the externally engaged gears satisfy a gear ratio required for a design, the externally engaged gears may each be formed in a shape of a simple pinion gear.

That is, referring to FIG. 3, when the drive external gear 320 is rotated in a clockwise direction and moved upward along the rack gear 110, the first idle external gear 330 is rotated in a counterclockwise direction thereof, the second idle external gear 340 is rotated in the clockwise direction thereof, and the driven external gear 350 is rotated in the counterclockwise direction thereof.

Therefore, the gear module 300 is moved upward, and simultaneously, the moving arm 400 is rotated in the counterclockwise direction so that the door 10 is separated from the vehicle body 20. On the other hand, when the gear module 300 is moved downwards, and simultaneously, the moving arm 400 is rotated in the clockwise direction thereof, the door 10 comes close to the vehicle body 20.

Furthermore, an operation of opening the door 10 from the vehicle body 20 may be implemented by a manual method or an automatic method.

That is, as described above, when the door 10 is manually pulled from the outside of the vehicle in a state in which the door 10 is closed, the gear module 300 is moved upward, and simultaneously, the moving arm 400 is rotated in the counterclockwise direction so that the door 10 may be opened from the vehicle body 20.

Meanwhile, when the door 10 is automatically opened, it may be configured to further include the motor M which provides a driving force to the drive external gear 320.

As an exemplary example, as shown in FIG. 3, a shaft of the motor M is coupled to an axis of the drive external gear 320 so that a rotating force of the motor M is directly provided to the drive external gear 320. Thus, the drive external gear 320 is moved along the rack gear 110 so that the moving arm 400 may be rotated.

Figure 4:
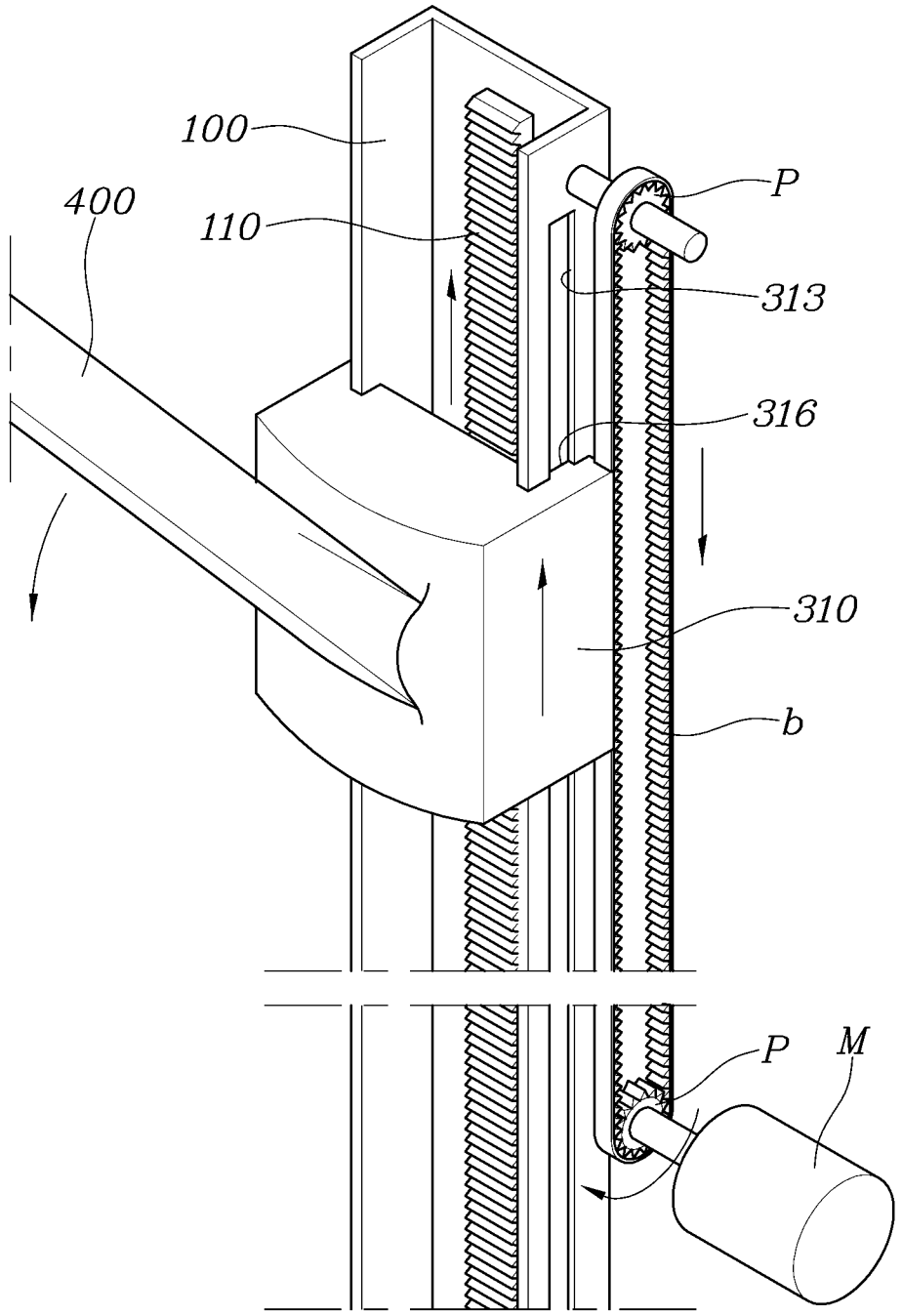
FIG. 4 is a diagram illustrating another exemplary embodiment in which the driving force of the motor is provided to the gear module according to various exemplary embodiments of the present invention.
Figure 5:
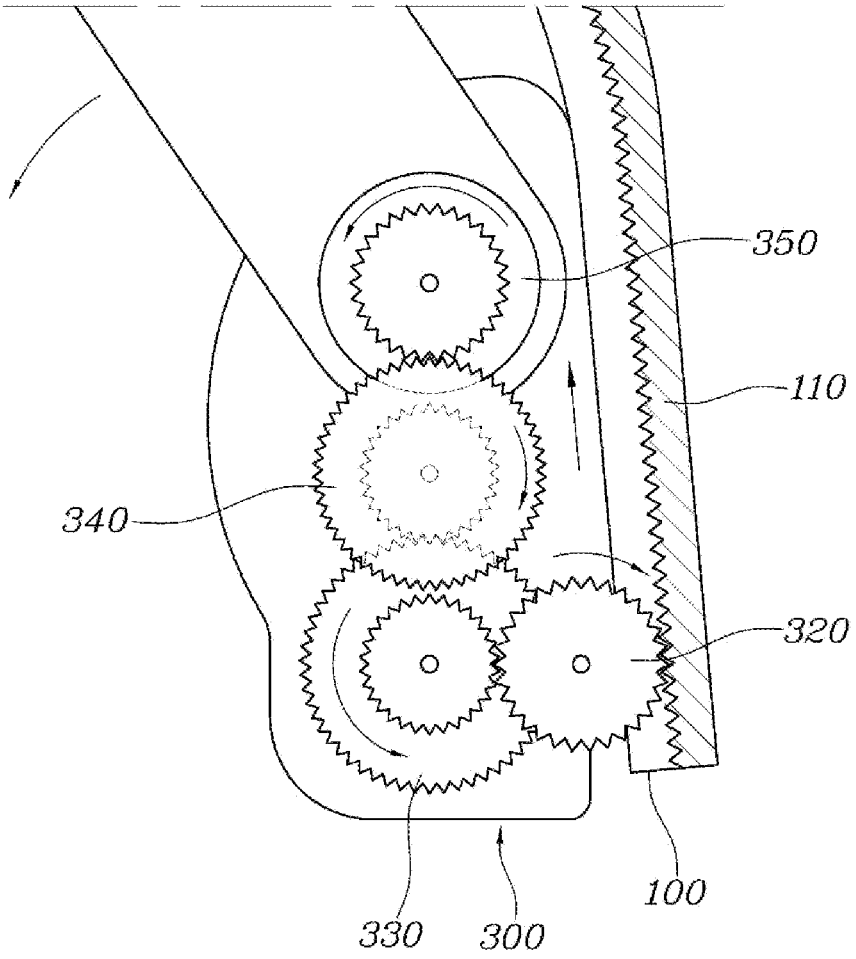
FIG. 5 is a diagram for describing an operating relationship of rotating a moving arm while the gear module is vertically moved d according to various exemplary embodiments of the present invention.

FIG. 4 is a diagram illustrating another exemplary embodiment in which the driving force of the motor M is provided to the gear module 300 according to various exemplary embodiments of the present invention.

Referring to the drawing, a belt pulley is connected to the shaft of the motor M, and the module housing 310 of the gear module 300 is coupled to an intermediate portion of a belt b. However, even in the instant case, a structure of the externally engaged gears in the gear module 300 may be configured as in the structure shown in FIG. 3.

That is, when the rotating force of the motor M is provided to a pulley p and thus the belt b is moved, the module housing 310 is vertically moved. Thus, the drive external gear 320 is moved along the rack gear 110 so that the moving arm 400 may be rotated.

Furthermore, according to various exemplary embodiments of the present invention, a gear ratio between the rack gear 110 and the driven external gear 350 may be configured such that the moving arm 400 is rotated from one end to the other end of an entire rotation section when the gear module 300 is moved from one end to the other end of an entire vertical movement section.

That is, when the drive external gear 320 reaches from one end to the other end of a movement range, a gear ratio is configured between gears engaged with each other such that the moving arm 400 reaches from one end to the other end of a rotation range according to the reaching of the drive external gear 320.

This may be expressed by the following equation.

$$Y=aX$$

Y: a gear ratio between a rack gear and a drive external gear

X: a gear ratio between a driven external gear and a second idle external gear a: a gear ratio between the drive external gear and the second idle external gear Meanwhile, according to various exemplary embodiments of the present invention, the door rail 100 may be mounted on an internal surface of the door frame 12, and the vehicle body rail 200 may be mounted on an external surface of a pillar.

The vehicle body rail 200 may be mounted in a curved shape along an A-pillar 22 or a C-pillar of the vehicle body 20, and the door rail 100 may be vertically provided in a portion of the door frame 12 corresponding to a B-pillar 24 of the vehicle body 20.

Figure 6:
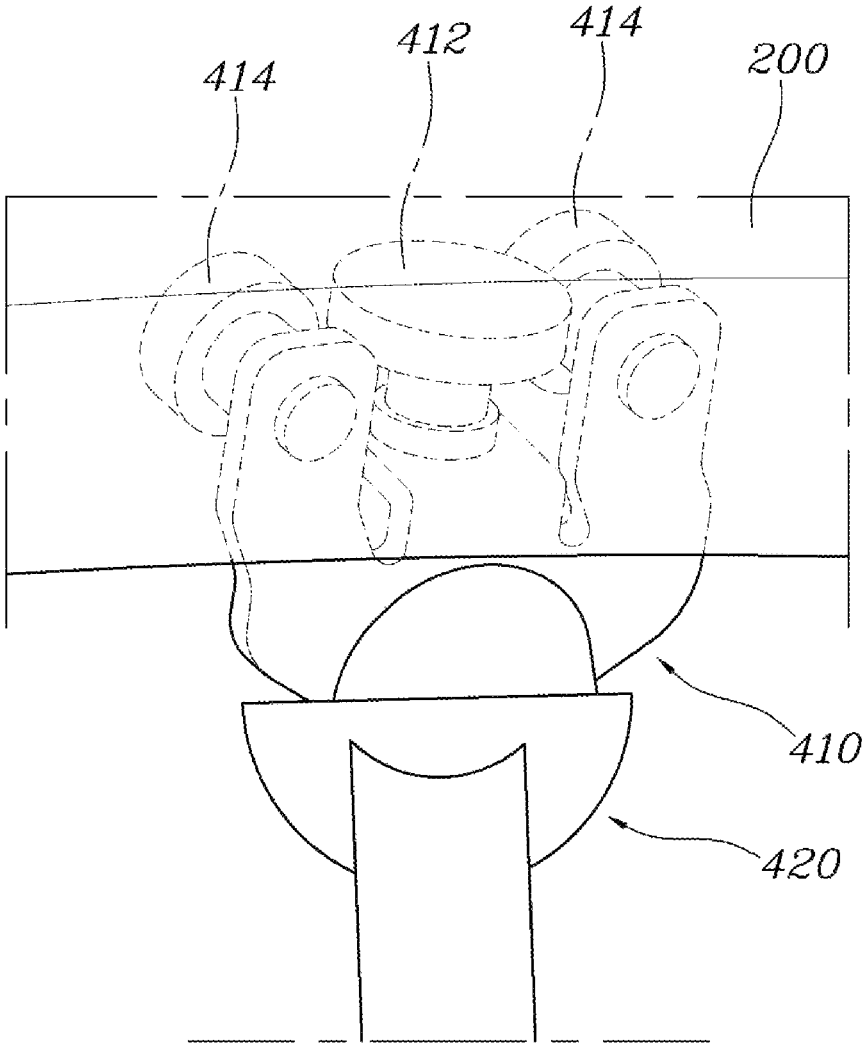
FIG. 6 is a diagram for describing a structure in which a roller portion is inserted into a vehicle body rail to be moved according to various exemplary embodiments of the present invention.

FIG. 6 is a diagram for describing a structure in which a roller portion 410 is inserted into the vehicle body rail 200 to be moved according to various exemplary embodiments of the present invention.

Referring to the drawing, according to various exemplary embodiments of the present invention, a guide slit 210 is formed on a surface of the vehicle body rail 200 facing the door 10 along a longitudinal direction thereof.

Furthermore, one end portion of the roller portion 410 is coupled to the other end portion of the moving arm 400 in a ball joint structure 420.

Furthermore, an intermediate portion of the roller portion 410 passes through the guide slit 210 so that a roller provided at the other end portion of the roller portion 410 is inserted into the vehicle body rail 200 and guided to be moved along the vehicle body rail 200.

For example, the vehicle body rail 200 is formed in a rectangular cross-sectional tube shape of which an internal is hollow and roll-moved in a state in which the roller is in contact with an internal surface of the vehicle body rail 200.

A center roller 412 may be provided at a center portion of the other end portion of the roller portion 410 to be roll-moved while being in contact with an internal wall surface of the vehicle body rail 200 in the front and rear direction thereof. Furthermore, side rollers 414 may be provided at both sides of the center roller 412 to be roll-moved while being in contact with the internal wall surface of the vehicle body rail 200 in the vertical direction thereof.

That is, when a force for moving the door 10 in a direction in which the door 10 is opened (a separate motor may be used) is provided in a state in which the door 10 is separated in the transverse direction of the vehicle body 20, the center roller 412 and the side rollers 414 may be in contact with the internal wall surface of the vehicle body rail 200 to be roll-moved so that the moving arm 400 may move along the vehicle body rail 200.

In an exemplary embodiment of the present invention, a rotation axis of the center roller 412 is aligned to be perpendicular to rotation axes of the side rollers 414.

A ball portion 413 is formed at one end portion of the roller portion 410 and a ball groove portion 415 for accommodating a ball of the ball portion 413 is formed at the other end portion of the moving arm 400 so that the ball portion 413 and the ball groove portion 415 are coupled in the ball joint structure 420. Thus, while the moving arm 400 moves along the vehicle body rail 200, a bending movement of the other end portion of the moving arm 400 moving downward may be absorbed through the ball joint structure 420.

Therefore, the vehicle body rail 200 of a curved shape is mounted in the front portion of the door 10 in which it is difficult to apply a straight rail in terms of a design, and it is configured to allow the moving arm 400 to move along the vehicle body rail 200. Consequently, the sliding door may be applied even to the front portion of the door 10.

Figure 7:
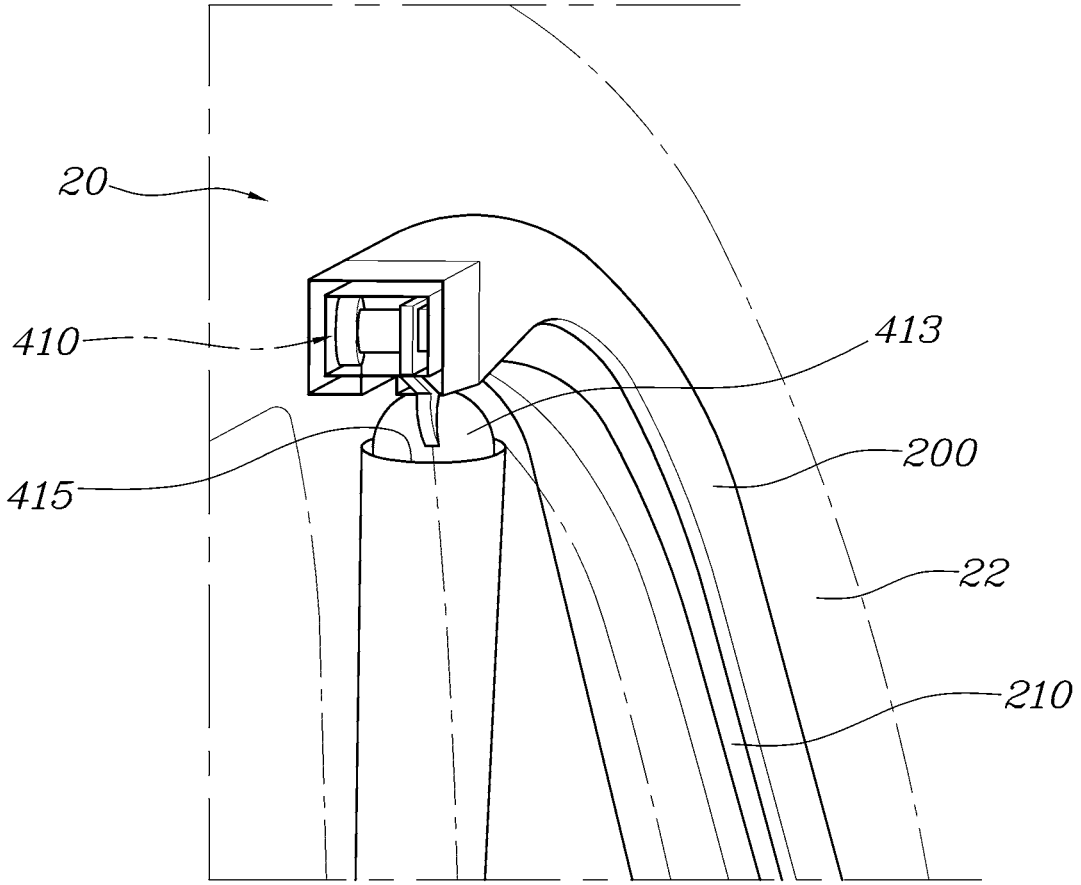
FIG. 7 is a diagram illustrating a torsional shape of the vehicle body rail according to various exemplary embodiments of the present invention.

Furthermore, FIG. 7 is a diagram illustrating a torsional shape of the vehicle body rail 200 according to various exemplary embodiments of the present invention. The vehicle body rail 200 may be formed in a torsional shape in the longitudinal direction so that an opening direction of the guide slit 210 close to the B pillar 24 may be formed to face a lower end portion of the door rail 100, and an opening direction of the guide slit 210 far away from the B pillar 24 may be formed to face the upper end portion of the door rail 100.

For example, when a sliding door is implemented in a front door portion, the vehicle body rail 200 is mounted in a portion of the vehicle body 20 forming the A-pillar 22 in a built-in structure. The opening direction of the guide slit 210 is formed downward in a rear side of the vehicle body rail 200 and accordingly, due to the torsional shape of the vehicle body rail 200, the opening direction of the guide slit 210 is formed toward a lateral direction in a front side of the vehicle body rail 200.

That is, while the door 10 is moved forward, the gear module 300 is moved to an upper portion of the door rail 100 so that a position of the one end portion of the moving arm 400 connected to the gear module 300 becomes gradually higher, and a position of the other end portion of the moving arm 400 becomes gradually lower.

Therefore, while the moving arm 400 moves forward along the vehicle body rail 200, the opening direction of the guide slit 210 is formed to face the gear module 300 so that the moving arm 400 smoothly moves along the vehicle body rail 200 without bending or damage of the moving arm 400.

As described above, according to various exemplary embodiments of the present invention, when the door 10 is opened, the moving arm 400 moves along the door rail 100 mounted in the vertical direction to adjust the distance between the vehicle body 20 and the door 10. Thus, since there is no need to configure the door rail 100 in the front and rear direction of the door 10, the sliding door may be applicable even to the door 10 in which it is difficult to implement a rail due to a layout problem of the interior of the door 10. It is possible to apply the sliding door even to the front portion of the door 10 in which the roof side portion is formed in a curved shape instead of a straight shape in terms of a design.

Furthermore, since the transverse movement amount of the door 10 is determined according to the length of the moving arm 400, when the door 10 is opened, the gap between the vehicle body 20 and the door 10 may be sufficiently secured as much as a desired level.

In accordance with various aspects of the present invention, when a door is opened, a moving arm moves along a door rail mounted in a vertical direction to adjust a distance between a vehicle body and the door so that, since there is no need to configure the door rail in a longitudinal direction of the door, there is an advantage in that a sliding door may be applicable to a door in which it is difficult to implement a rail due to a layout problem inside the door. Furthermore, there is an advantage in that it is possible to apply the sliding door even to a front portion of the door in which a roof side portion is formed in a curved shape instead of a straight shape in terms of a design.

Furthermore, since a transverse movement amount of the door is determined according to a length of the moving arm, when the door is opened, a gap between the vehicle body and the door may be sufficiently secured as much as a desired level.

For convenience in explanation and accurate definition in the appended claims, the terms "upper", "lower", "inner", "outer", "up", "down", "upwards", "downwards", "front", "rear", "back", "inside", "outside", "inwardly", "outwardly", "internal", "external", "inner", "outer", "forwards", and "backwards" are used to describe features of the exemplary embodiments with reference to the positions of such features as displayed in the figures. It will be further understood that the term "connect" or its derivatives refer both to direct and indirect connection.

The foregoing descriptions of specific exemplary embodiments of the present invention have been presented for purposes of illustration and description. They are not intended to be exhaustive or to limit the present invention to the precise forms disclosed, and obviously many modifications and variations are possible in light of the above teachings. The exemplary embodiments were chosen and described to explain certain principles of the present invention and their practical application, to enable others skilled in the art to make and utilize various exemplary embodiments of the present invention, as well as various alternatives and modifications thereof. It is intended that the scope of the present invention be defined by the Claims appended hereto and their equivalents.

What is claimed is:

1. A sliding door apparatus for a vehicle, the sliding door apparatus comprising:

a door rail mounted in a door which is configured to be closed to a vehicle body in a vertical direction of the vehicle;

a vehicle body rail mounted in the vehicle body to which the door is configured to be closed in a longitudinal direction of the vehicle; and a moving arm having a first end portion which is movably coupled along the door rail in the vertical direction to open or close the door in a transverse direction of the vehicle body during moving of the moving arm, and a second end portion which is movably coupled along the vehicle body rail in the longitudinal direction to allow the door to be slidingly moved in the longitudinal direction of the vehicle body during moving of the moving arm.

2. The sliding door apparatus of claim 1, wherein a rack gear is mounted along the door rail; and wherein a gear module is gear-engaged to the rack gear at the first end portion of the moving arm to be moved in the vertical direction and to rotate the first end portion of the moving arm.

3. The sliding door apparatus of claim 2, wherein the gear module includes:

a module housing coupled to the door rail and guided by the door rail to slide in the vertical direction;

a drive gear rotatably coupled to the module housing and engaged with the rack gear;

a driven gear rotatably coupled to the module housing and fixed to the first end portion of the moving arm; and an idle gear rotatably coupled to the module housing and engaged to the drive gear and the driven gear, and configured to transmit a rotating force of the drive gear to the driven gear.

4. The sliding door apparatus of claim 3, further including:

a motor coupled to the drive gear and configured to provide a driving force to the drive gear.

5. The sliding door apparatus of claim 4, further including:

a first pulley fixed to a shaft of the motor;

a second pulley rotatably mounted to the door rail; and a belt coupled to the first pulley and the second pulley and connected to the module housing.

6. The sliding door apparatus of claim 3, wherein, when the gear module is moved from one end to another end of an entire vertical movement section, a gear ratio between the rack gear and the driven gear is configured such that the moving arm is rotated from an one end to another of an entire rotation section.

7. The sliding door apparatus of claim 3, wherein rail grooves are formed on first and second side surfaces of the door rail, and rail protrusions inserted into the rail grooves are formed at first and second sides of the module housing so that the module housing is coupled to the door rail to slidingly move in the vertical direction.

8. The sliding door apparatus of claim 1, wherein the door rail is mounted on an internal surface of a door frame; and wherein the vehicle body rail is mounted on an external surface of a pillar.

9. The sliding door apparatus of claim 1, wherein the vehicle body rail is mounted in a curved shape along an A-pillar or a C-pillar of the vehicle body; and wherein the door rail is vertically mounted in a portion of a door frame corresponding to a B pillar of the vehicle body.

10. The sliding door apparatus of claim 9, wherein a guide slit is formed on a surface of the vehicle body rail facing the door in the longitudinal direction;

wherein a first end portion of a roller portion is coupled to the second end portion of the moving arm in a ball joint structure; and wherein an intermediate portion of the roller portion passes through the guide slit, and a roller provided at a second end portion of the roller portion is inserted into the vehicle body rail and guided to be moved along the vehicle body rail.

11. The sliding door apparatus of claim 10, wherein the vehicle body rail is formed in a torsional shape in the longitudinal direction thereof, the guide slit of the vehicle body rail adjacent to the B pillar is formed to face a lower end portion of the door rail, and the guide slit of the vehicle body rail spaced away from the B pillar is formed to face an upper end portion of the door rail.

12. The sliding door apparatus of claim 10, wherein a ball portion is formed at the first end portion of the roller portion and a ball groove portion for accommodating a ball of the ball portion is formed at the second end portion of the moving arm so that the ball portion and the ball groove portion are coupled in the ball joint structure.

13. The sliding door apparatus of claim 10, wherein the roller includes a first side roller, a center roller and a second side roller.

14. The sliding door apparatus of claim 13, wherein a rotation axis of the center roller is aligned to be perpendicular to rotation axes of the first side roller and the second side roller.

* * * * *